US008291597B2

(12) United States Patent
Hawk et al.

(10) Patent No.: US 8,291,597 B2
(45) Date of Patent: Oct. 23, 2012

(54) FOLDING KNIFE WITH SEALED MECHANISM

(75) Inventors: Grant W. Hawk, Idaho City, ID (US); Gavin D. Hawk, Idaho City, ID (US)

(73) Assignee: Kai U.S.A. Ltd., Tualatin, OR (US)

( * ) Notice: Subject to any disclaimer, the term of this patent is extended or adjusted under 35 U.S.C. 154(b) by 1204 days.

(21) Appl. No.: 11/701,119

(22) Filed: Jan. 31, 2007

(65) Prior Publication Data

US 2007/0180702 A1 Aug. 9, 2007

Related U.S. Application Data

(60) Provisional application No. 60/765,754, filed on Feb. 6, 2006.

(51) Int. Cl.
*B26B 3/06* (2006.01)

(52) U.S. Cl. ..... 30/155; 30/157; 30/158

(58) Field of Classification Search ..... 30/155–163
See application file for complete search history.

(56) References Cited

U.S. PATENT DOCUMENTS

| | | | | | |
|---|---|---|---|---|---|
| 226,910 | A | | 4/1880 | Friebertshauser | |
| 1,743,022 | A | | 10/1927 | Carman | |
| 2,250,290 | A | * | 7/1941 | Berg | 30/160 |
| 3,590,483 | A | * | 7/1971 | Szczepanski | 30/31 |
| 3,851,986 | A | * | 12/1974 | Daughtry | 403/373 |
| 4,148,140 | A | * | 4/1979 | Lile | 30/161 |
| 4,170,061 | A | * | 10/1979 | Henry | 30/160 |
| 4,321,750 | A | * | 3/1982 | Sugihara | 30/384 |
| 4,772,150 | A | * | 9/1988 | Horton | 403/39 |
| 4,794,692 | A | * | 1/1989 | Wang | 30/123 |
| 4,854,045 | A | * | 8/1989 | Schaub | 30/155 |
| 4,893,409 | A | | 1/1990 | Poehlmann | |
| 5,111,581 | A | | 5/1992 | Collins | |
| 5,615,484 | A | | 4/1997 | Pittman | |
| 5,665,099 | A | * | 9/1997 | Pilo et al. | 606/167 |
| 5,839,194 | A | * | 11/1998 | Bezold | 30/161 |
| 5,862,552 | A | * | 1/1999 | Koelewyn | 7/132 |
| 5,964,036 | A | | 10/1999 | Centofante | |
| 6,122,829 | A | | 9/2000 | McHenry et al. | |
| 6,223,372 | B1 | | 5/2001 | Barber | |
| 6,338,431 | B1 | | 1/2002 | Onion | |
| 6,427,334 | B2 | | 8/2002 | Onion | |
| 6,481,034 | B2 | * | 11/2002 | Elsener et al. | 7/118 |
| 7,284,329 | B1 | * | 10/2007 | King | 30/161 |
| 2004/0158991 | A1 | * | 8/2004 | Freeman | 30/161 |
| 2007/0256304 | A1 | * | 11/2007 | Pardue et al. | 30/160 |
| 2008/0201953 | A1 | * | 8/2008 | Bremer et al. | 30/1 |

* cited by examiner

*Primary Examiner* — Boyer D Ashley
*Assistant Examiner* — Omar Flores-Sánchez
(74) *Attorney, Agent, or Firm* — Seed IP Law Group PLLC

(57) ABSTRACT

A folding knife includes a handle having a blade channel, a blade rotatably coupled to the handle, and annular blade seals coupled to either side of the blade between the blade and inner surfaces of the blade channel. A locking mechanism having first and second control pins coupled to the blade within the circumference of the blade seal so as to extend toward the first handle element. A lock plate is movably coupled to the handle and engages the first and second control pins when the blade is in the open and closed positions, respectively. A release knob coupled to the lock plate allows a user to move the lock plate to release the blade. A seal positioned between the release knob and the handle seals a space between the release knob and the handle.

36 Claims, 3 Drawing Sheets

FOLDING KNIFE WITH SEALED MECHANISM

CROSS-REFERENCE TO RELATED APPLICATION

This application claims the benefit of U.S. Provisional Patent Application No. 60/765,754 filed Feb. 6, 2006, where this provisional application is incorporated herein by reference in its entirety.

BACKGROUND OF THE INVENTION

1. Field of the Invention

The present invention is related to the field of folding knives, and in particular to folding knives having sealed pivot and locking mechanisms.

2. Description of the Related Art

Folding knives have been popular for centuries because of their relative safety and convenience. They have found use in an extremely wide range of applications, and are especially popular among sportsmen and individuals who work outdoors. Many folding knives, especially larger knives or those subjected to strenuous use, are provided with a lock that must be released before the blade can be closed. This enhances the safety of such knives, and further reduces the likelihood of injury.

One difficulty that has been encountered is that the pivot mechanism of many folding knives is prone to fouling due to the introduction into the mechanism of contaminants such as mud, sand, fine grit, organic matter, etc. The contaminants can interfere with opening or closing of the blade, and, in cases where the knives are not easily disassembleable, can be very difficult to clean. This can also damage the knife if not removed.

BRIEF SUMMARY OF THE INVENTION

According to various embodiments, a pivot mechanism of a folding knife is effectively sealed from contaminants. According to one embodiment, the folding knife has a handle having first and second handle elements and a blade coupled to the handle and configured to rotate around a pivot axis between an open position and a closed position. An annular blade seal is positioned between the blade and the first handle element and contacting an inner surface of the first handle element so as to substantially seal a space between the blade and the first handle element and circumscribed by the blade seal.

First and second control pins are coupled to the blade within the circumference of the blade seal so as to extend toward the first handle element. A lock plate is movably coupled to the first handle element and configured to engage the first and second control pins when the blade is in the open and closed positions, respectively, such that the lock plate resists movement of the blade away from the open and closed positions when engaged, respectively, with the first and second control pins.

A release knob coupled to the lock plate permits a user to move the lock plate to release engagement with the blade. A seal is positioned between the release knob and the first handle element to seal a space between the release knob and the first handle element.

BRIEF DESCRIPTION OF THE SEVERAL VIEWS OF THE DRAWING(S)

DETAILED DESCRIPTION OF THE INVENTION

Figure 1:
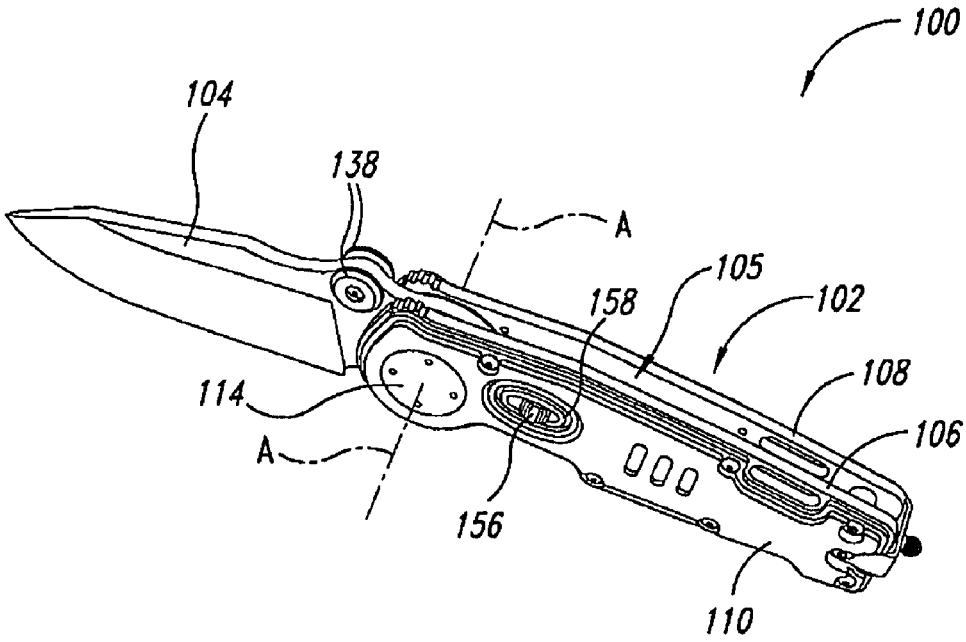
FIG. 1 is a perspective view of a folding knife according to an embodiment of the invention

For the purposes of clarity and ease of comprehension, directional terms such as, for example, top, bottom, right, and left may be used in describing embodiments, and will be with reference to elements as they appear on the figures. Where elements are described using terms such as inner or outer, this is with respect to a central plane of the knife, i.e., a plane that lies parallel to, and substantially centered between, the first and second frame members. Thus, a side of an element that lies closer to that center plane than another side of the element may be described as the inner side of the element. Additionally, an element or feature that lies closer to the axis of rotation of the blade than another element or feature may be described as being inside the other feature.

Elements that are, in the illustrated embodiment, substantially identical will be identified by identical reference numbers. Where it is necessary to distinguish between such identical elements in the description, letters will be used. Fasteners, which may be screws, rivets, pins, or other suitable devices such as are well known in the art, and which may or may not be identical, are indicated generically by reference number 140.

An embodiment will be described with reference to FIGS. 1-6.

The knife 100 includes a handle 102 and a blade 104. The handle 102 includes first and second frame members 106, 108 arranged in a spaced-apart relationship, with a space, or blade channel 105, between them. First and second handle overlays 110, 112 are affixed to outer faces of the first and second frame members 106, 108, respectively, by fasteners 140. A spacer 105 is positioned between the first and second frame members 106, 108 at a rear end of the handle 102, and a pocket clip 170 with a decorative knob 172 is coupled to the first frame member 106 by a fastener 140.

Figure 2:
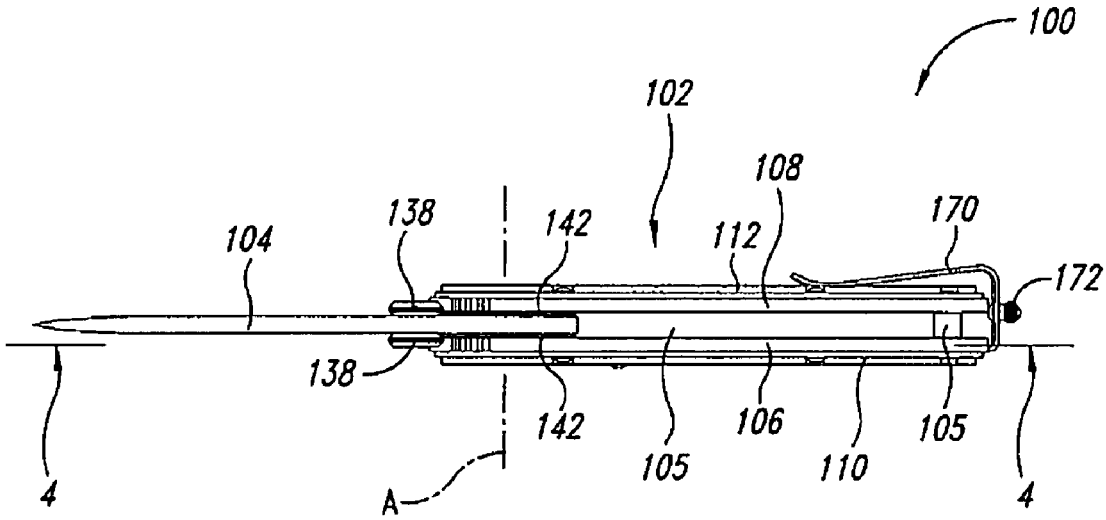
FIG. 2 is a top plan view of the knife of FIG. 1.
Figure 4:
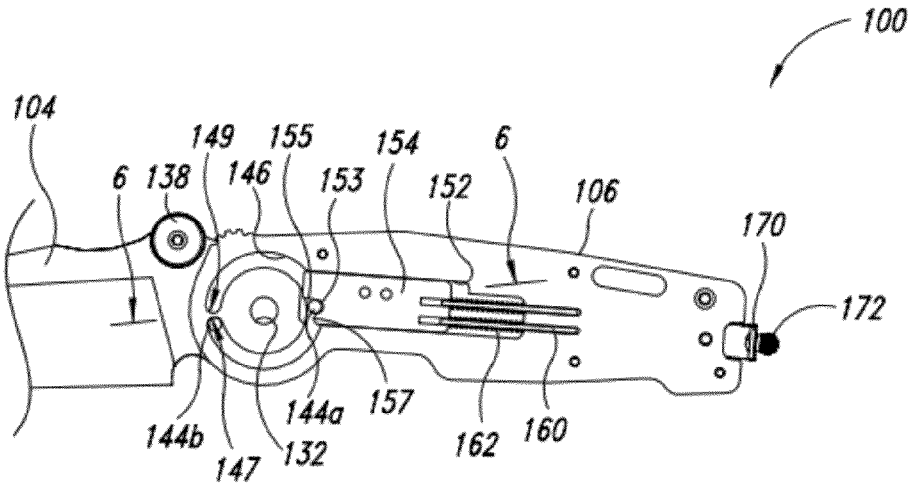
FIG. 4 shows a cross-sectional view of the knife of FIG. 2 taken along lines 4-4, with the knife in an open position.
Figure 5:
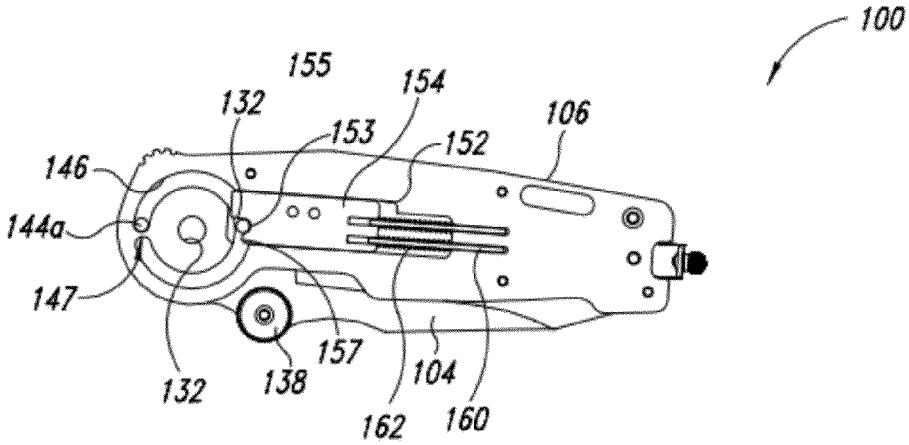
FIG. 5 shows a cross-sectional view of the knife of FIG. 2 taken along lines 4-4, with the knife in a closed position.

The blade 104 is coupled to the handle 102 so as to rotate around a pivot axis A with respect to the handle 102, between an open position, as shown in FIGS. 1, 2 and 4, in which the sharp edge of the blade 104 is exposed, and a closed position, as shown, for example, in FIG. 5, in which the blade lies with the sharp edge within the channel 105, between the first and second frame members 106, 108. In other embodiments of the invention, the blade may be positioned in the blade channel to a greater or lesser degree than that shown in the pictured embodiment.

The blade 104 includes a blade pivot aperture 126 formed coaxially with the pivot axis A, and control apertures 130*a*, 130*b* positioned some distance from the pivot axis A. The blade pivot aperture 126 and the control apertures 130*a*, 130*b* traverse the blade 104. Annular blade seal grooves 128 are formed in opposite faces of the blade 104, positioned coaxially with the pivot axis A. Thumb studs 137 are positioned on the blade 104 for access by a user, to assist in moving the blade 104 from the closed position to the open position.

In one embodiment, the thumb studs 140 are in the form of knurled discs coupled to the blade 104 by fasteners 140 that threadingly engage a splined sleeve that is pressed into a stud aperture formed in the blade 104. Other structures for thumb studs that serve a similar function are well known in the art, and are within the scope of the invention.

Frame pivot apertures 132 are provided in each of the first and second handle frame members 106, 108, and each of the first and second handle overlays 110, 112 is provided with an overlay pivot aperture 134. The pivot apertures 132 and 134 are positioned so as to be substantially coaxial with the pivot axis A when the knife 100 is properly assembled.

The blade 104 is pivotably coupled to the handle 102 by a blade pivot 114. The blade pivot 114 includes an internally threaded pivot tube 122 and pivot screws 116. The pivot screws 116 have enlarged heads 118, and shafts 120 that are threaded to engage the inside wall of the respective ends of the pivot tube 122. The pivot tube 122 has a central region 121 that has a first diameter, and end regions 123 that have a smaller, second diameter. A ridge or shoulder 125 is thereby formed near each end where the diameter of the pivot tube 122 changes from the first diameter to the second diameter. The first diameter of the pivot tube 122 is greater than a diameter of the frame pivot apertures 132, while the second diameter is smaller.

Figure 6:
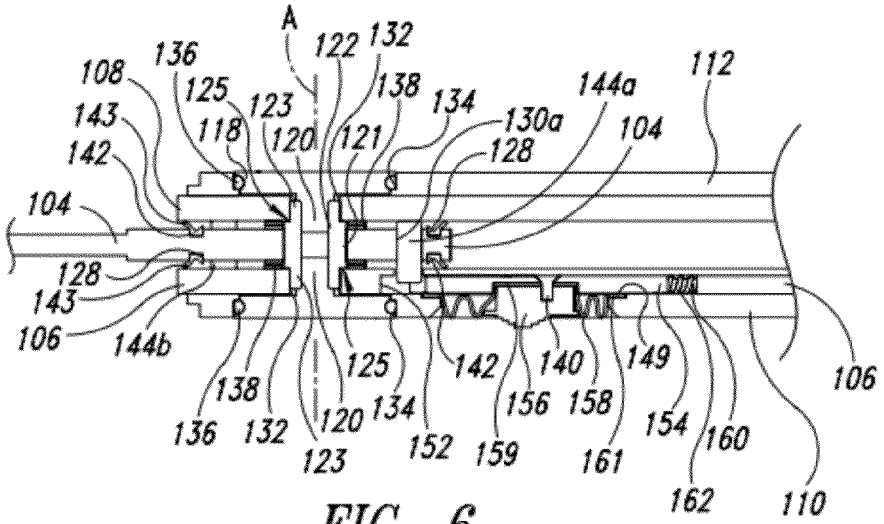
FIG. 6 shows a cross sectional view of the knife of FIG. 4 taken along lines 6-6.

Two pivot seal members 136 are positioned on the blade pivot screws 116. As shown in FIG. 6, the outer rim of the enlarged heads 118 of the pivot screws 116 and the inner rim of the overlay pivot apertures 134 are shaped and sized to cooperate to hold the pivot seal members 136 therebetween. The pivot seal effectively seals the pivot 114 from entry of contamination around the pivot screws 116.

When the knife 100 is assembled, as shown in detail in FIG. 6, the pivot tube 122 traverses the blade pivot aperture 126 such that the pivot tube 122 extends outward from either side of the blade 104. The end regions 123 of the pivot tube 122 extend into the frame pivot apertures 132, and the shafts 120 of the pivot screws 116, which traverse the overlay pivot apertures 134 and the frame pivot apertures 132, engage respective ends of the pivot tube 122. Inward biasing force from the enlarged heads 118 of the pivot screw 116 is transferred, via the pivot seal members 136, to the first and second handle overlays 110, 112, pressing the handle overlays firmly against the respective handle frame members 106, 108, and drawing the shoulders 125 of the pivot tube against the inner surfaces of the first and second frame members 106, 108. Flat bushings or washers 138 are positioned on the pivot tube 122 between the outer surfaces of the blade 104 and the inner surfaces of the first and second frame members 106, 108. The bushings 138 can also be seals or gaskets in some embodiments.

In one embodiment, the minimum distance between the first and second handle frame members is fixed by the length of the central region 121 of the pivot tube 122, i.e., the distance between the shoulders 125 of the pivot tube 122. Accordingly, this distance can be selected to be slightly greater than the sum of the thicknesses of the blade 104 and the flat bushings 138, such that, regardless of the degree to which the pivot screws 116 are tightened, the blade 104 will retain a selected minimum amount of freedom of movement. On the other hand, if the length of the central region 121 is equal to, or less than the sum of the thicknesses of the blade 104 and the flat bushings 138, the degree of freedom of movement of the blade 104 will be more directly controlled by the degree to which the pivot screws 116 are tightened.

According to an alternate embodiment of the invention, the pivot tube 122 has only one outer diameter, equal to the second diameter of the pictured embodiment, such that there are no shoulders. Other embodiments employ more conventional pivots such as are well known in the art. In these embodiments, as well, the degree of tension applied to the pivot controls the degree of freedom of movement of the blade.

Controlling the freedom of movement of the blade by providing more or less tension on the pivot is well known in the art, and is a feature of many folding knives currently available. However, a problem with this method is that, frequently, a knife pivot cannot be tightened to a degree sufficient to lock a pivot screw in place, without exerting excessive pressure and drag on the blade, and making it difficult to move the blade between the open and closed positions. As a result, the pivot screw will tend to loosen over time. According to the present embodiment and other embodiments that employ pivot seals, this problem is substantially overcome. The pivot seal members 136 are O-rings formed of an elastomeric material, and dimensioned such that, when the enlarged heads 118 of the pivot screws 116 are positioned in overlay pivot apertures 134 with the pivot seal members 136 therebetween, the pivot seal members 136 resiliently press against the outer rims of the enlarged heads 118 of the pivot screws 116 and the inner rims of the overlay pivot apertures 134, exerting a degree of friction between the pivot screws 116 and the respective handle overlays 110, 112 sufficient to prevent the pivot screws 116 from spontaneously loosening.

Annular blade seal members 142 are positioned in the blade seal grooves 128, and are dimensioned so as to make contact with the inner surfaces of the first and second frame members 106, 108. As shown in FIG. 6, the blade seal members 128 include sweep rims 143 that extend outward from the blade seal member 142, and make resilient contact with the inner surfaces of the first and second frame members 106, 108. The sweep rims 143 extend away from the pivot axis A, such that inward pressure directed toward the pivot axis A from outside the blade seal members 142 will tend to increase a sealing force of the sweep rims 143 against the respective inner surfaces of the first and second frame members 106, 108, thereby resisting the passage of contaminants that would otherwise move in toward the pivot 114.

Because the blade seal members 142 are annular, and are positioned coaxially with the pivot axis A, the sweep rims 143 follow a continuous circular path around the pivot axis A on the inner surfaces of the frame members 106, 108 as the blade 104 rotates between the open and closed positions. As a result, not only do the blade seal members 142 prevent contaminants from being introduced into the pivot mechanism of the knife, but the sweep rims 143 move continually on a clean surface, and so are not required to move contaminating particles away. They are therefore not subject to a high degree of abrasion or wear while the blade moves, even in environments that would tend to introduce very abrasive particles into the knife.

In tests performed by the inventors, a folding knife that included blade seal members similar to those described above was moved through repeated cycles between the open and closed positions while immersed in extremely fine sand and grit. The knife was then disassembled and examined. No contaminating grit was found inside the mechanism, and no appreciable wear to the blade seal members was detected. The seals are also liquid tight. Tests were also conducted underwater and no water was found to have entered the inside of the mechanism. In high grit environments, such as the desert, or under messy conditions, such as cleaning a game animal or fish, mud, grit, blood, fur, or other contaminants are kept out of the moving mechanism of the knife and it is easy to clean.

According to an alternate embodiment, the blade seal groves are formed in the inner faces of the first and second frame members, and the blade seal members are positioned in the blade seal grooves so as to make resilient contact with opposing faces of the blade.

In one embodiment, a locking mechanism 150 is provided to retain the blade 104 in the open and closed positions. The locking mechanism includes a lock plate 154 having a notch 153, with first and second sides 155, 157, and positioned, in the pictured embodiment, in a cavity 152 formed in the first frame member 106. The cavity 152 is sized to permit translational movement of the lock plate 154, and biasing means are provided to bias the lock plate 154 substantially toward the pivot axis A. In the pictured embodiment, the bias means comprises springs 162 and guide rods 160, but a wide variety of mechanisms may be employed as biasing means, and substituted for the springs, such as, for example, flexible rods, leaf springs, torsion springs, etc. The locking mechanism also includes first and second control pins 144*a*, 144*b* positioned in the control apertures 130*a*, 130*b*, respectively, and a release knob 156 coupled to the lock plate 154 by fasteners 148, and accessible to a user via a knob aperture 143 formed in the first handle overlay 110.

Figure 3:
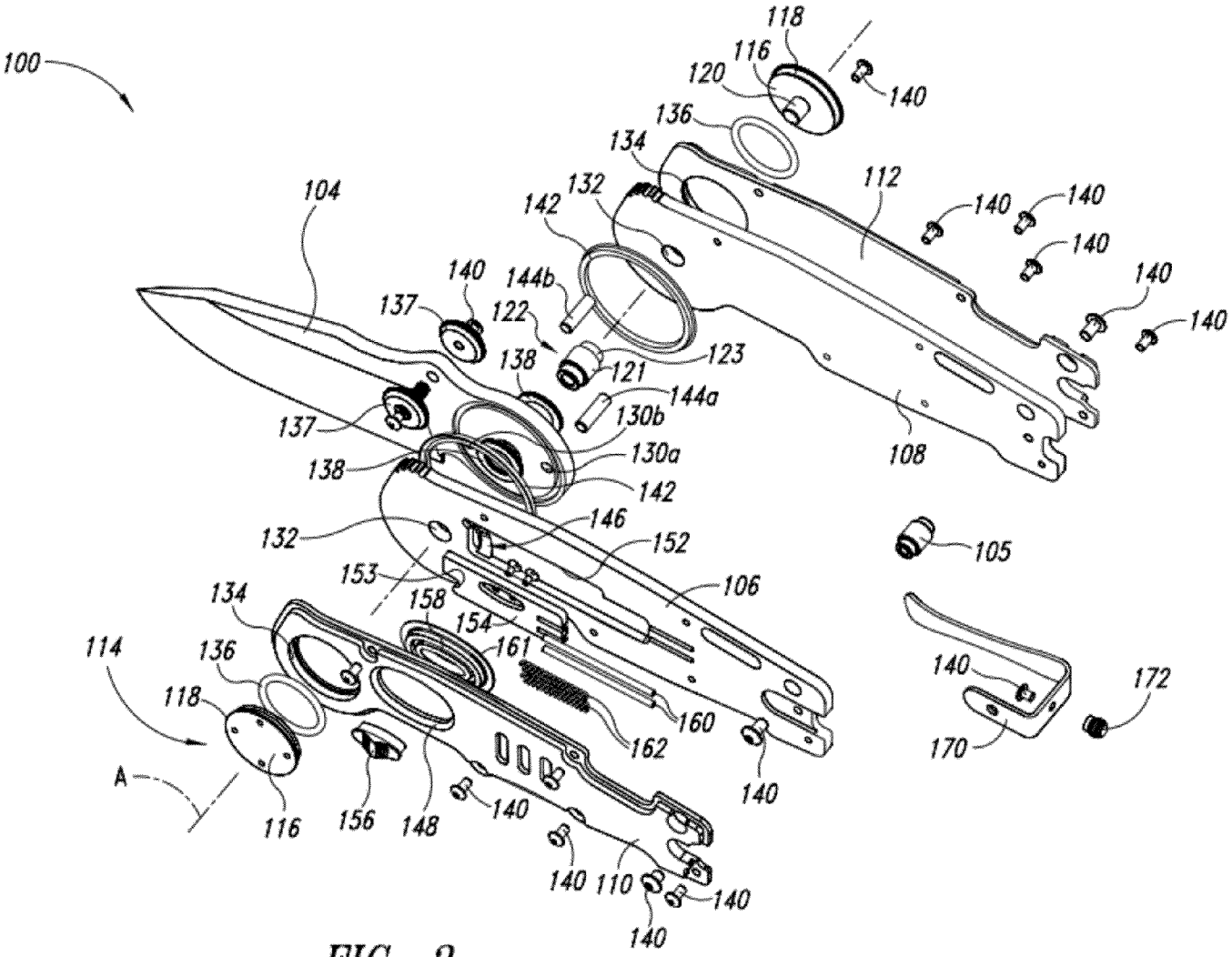
FIG. 3 shows the knife of FIG. 1 in an exploded view.

Operation of the locking mechanism 150 will be described with reference, in particular, to FIGS. 4 and 5. The first frame member 106 is provided with an arcuate pin race 146 formed in the inner face of the first frame member 146 and having first and second ends 147 and 149. The pin race 146 is positioned coaxially with the pivot axis A, and inside the circumference of the blade seal members described above. The pin race 146 and the cavity 152 are formed in opposite faces of the frame member 106, but are of depths such that they intersect in an area where they overlap, as can be seen in FIG. 3, where a small portion of the race 146 is visible inside the cavity 152. The cross section of FIGS. 4 and 5 is taken through the first frame member 106 at a depth that shows both the cavity 152 and the race 146.

As previously described, the blade 104 is provided with control apertures 130*a*, 130*b*. The first and second control pins 144*a*, 144*b* are positioned in respective control apertures 130*a*, 130*b*, and extend from the blade 104 into the pin race 146. As the blade rotates between the open and closed position, the control pins 144*a*, 144*b* slide within the pin race 146 in an arc around the pivot axis A. One or both of the first and second ends 147, 149 of the pin race 146 may be configured to serve as rotation stops for the blade 104, to limit movement of the blade 104 to an arc of travel between the open and closed positions.

FIG. 4, which shows the knife 100 with the blade 104 in the open position, shows the notch 153 of the lock plate 154 in engagement with the first control pin 144*a*. It can be seen that, as viewed in FIG. 4, the first control pin 144*a* must rotate in a counterclockwise direction around the pivot axis A when the blade 104 is moved from the open position toward the closed position. The first side 155 of the notch 153 is shaped such that, while the lock plate 154 is engaged with the first control pin 144*a*, it will prevent movement of the blade 104 toward the closed position. Rotational force applied to the blade 104 is transferred to the first control pin 144*a*, and thence to the lock plate 154 at a vector that is nearly perpendicular to the direction of movement of the lock plate 154. Thus, the lock plate 154 binds against the side of the cavity 152 and does not permit passage of the first control pin 144*a*.

In order to move the blade 104 away from the open position, it is necessary that the lock plate be manually moved out of engagement with the first control pin 144*a*. A user does this by sliding the release knob 156 in a direction away from the pivot axis A while moving the blade 104 away from the open position. On the other hand, when the blade 104 is moved into the open position, the first control pin 144*a* approaches engagement with the lock plate 154, and pushes against an end face of the lock plate 154, applying force at a vector that easily moves the lock plate 154 rightward a distance sufficient to permit passage of the first control pin 144*a*. Thus, as configured in the present embodiment, the blade 104 moves easily into the open position and is automatically locked there until it is manually released for movement toward the closed position.

In the illustrated embodiment, the first end 147 of the pin race 146 defines the limit of travel of the blade 104 in the clockwise direction. When the blade is moved to the open position, the second control pin 144*b* makes contact with the first end 147 of the pin race 146, which prevents further movement. The notch 153 of the lock plate 154 has a shape such that the first side 155 of the notch 153 engages the first control pin 144*a* before the lock plate 154 reaches the leftmost end of the cavity 152. This allows the lock plate 154, in engagement with the first pin 144*a*, to cooperate with the first end 147 of the pin race 146, in engagement with the second control pin 144*b*, to provide a solid lock to the blade 104, substantially without play.

According to an alternate embodiment, an additional pin race is provided in the inner face of the second frame member 108. The additional pin race may be configured to receive only one, or both of the first and second control pins 144*a*, 144*b*, and provide additional rotation stops, to reduce asymmetrical forces acting on the blade 104.

FIG. 5, which shows the knife 100 with the blade 104 in the closed position, shows the notch 153 of the lock plate 154 in engagement with the second control pin 144*b*. It can be seen that, as viewed in FIG. 5, the second control pin 144*b* must rotate in a clockwise direction around the pivot axis A when the blade is moved from the closed position toward the open position. The second side 157 of the notch 153 is shaped such that the lock plate 154 will resist movement of the blade 104 toward the open position. In one embodiment, the shape of the second side 157 is selected such that when sufficient rotational force is applied to the blade 104, the second control pin 144*b* pressing against the second side 157 of the notch 153 will drive the plate 152 in a rightward direction against the biasing force applied by the springs 162, thereby releasing the blade 104 to move toward the open position. Thus, the locking mechanism 150 acts as a detent mechanism to releasably hold the blade in the closed position. The shape of the second side 157, and the biasing force of the springs 162 can be selected to control the degree of force necessary to overcome the resistance of the lock plate 154 to movement of the blade 104.

According to one embodiment, the required biasing force is selected such that, in normal operation, when a user applies a force sufficient to overcome the resistance of the lock plate 154, the same force is sufficient to move the blade 104 all the way to the open position. The force applied to start movement of the blade from the closed position toward the open position will cause the blade to complete the movement without further effort. Thus, a user may press against a thumb stud or some other feature of the blade until the blade begins to move, and the blade will thereafter complete the movement independently.

An example of a suitable blade feature against which a user may press to open the blade is an element sometimes referred to as a flipper. This is an enlarged portion of the blade that extends from a back part of the handle when the blade is in the closed position, such that pressure against the enlarged portion will move the blade away from the closed position. A number of terms are used in the art to refer to this enlarged portion, including flipper, trigger, kicker, ridge, etc. One example of such a feature is described in U.S. Pat. No. 6,338,431, which is incorporated herein by reference, in its entirety.

According to an alternative embodiment, the second side 157 is shaped such that the blade 104 cannot be moved toward the open position without manual movement of the lock plate 154, in a manner similar to that described above with reference to first side 155. The first side 155 of the notch lock plate may also be configured to act as a detent, allowing the blade to be moved away from the open position when sufficient force toward the closed position is applied to the blade. In the case of an embodiment in which the knife 100 is provided with an automatic opening mechanism, the locking mechanism may be configured to provide a manual release for automatic opening of the blade, as well as a lock to prevent the blade from inadvertent closure.

A bellows seal 158 is provided around the release knob 156, as shown in FIGS. 1 and 6. The bellows seal 158 is formed from an elastomeric material such as, for example, synthetic rubber, and includes a rim region 161 and a central region 159. The central region 159 is captured between the lock plate 154 and the release knob 156 by fasteners 140, and the rim region 161 is affixed by a suitable adhesive to the inner surface of the first handle overlay 110 around the release aperture 148 so as to provide a seal between the release knob 156 and the handle overlay 110, while permitting movement of the release knob 156 in order to disengage the lock plate 154 as previously described. In the present embodiment, the first handle overlay 110 includes a shallow rim 149 formed in the inner surface of the overlay around the release aperture 148, into which the rim region 161 is affixed.

According to the illustrated embodiment, the first and second handle overlays 110, 112 are affixed to the first and second frame members 106, 108 by fasteners 140 such that substantially planar inner surfaces of the handle overlays are in direct and firm contact with substantially planar outer surfaces of the frame members. The inventors have determined that such a configuration is sufficient to provide a reliable seal between the overlays and the frame members. According to an alternate embodiment, a thin gasket seal is provided between the overlays and the frame members. Such an arrangement may be desirable where the knife is intended for use where it will be under water for long periods, or under increased pressure, such as in diving, to prevent water from working between the overlays and frame members. In that embodiment, the bellows seal may be formed as an integral portion of the gasket seal.

Many variations on the disclosed embodiments can be made within the present invention. Some embodiments do not include all the elements of the disclosed embodiments, and some combine elements disclosed here with more conventional aspects. For example, in the embodiment shown, the blade channel extends through the knife, from the top side to the bottom, with only the pivot and the spacer extending between the first and second frame members. This arrangement is advantageous because it minimizes the places where foreign matter can gather. Nevertheless, such an arrangement is not essential to the invention. Other embodiments may include a channel that is open only at the bottom of the knife. Furthermore, the locking mechanism described here can be used in a knife that does not employ the seals, and, conversely, various ones of the disclosed sealing mechanisms may be employed in knives that use more conventional locks.

Some of the features of the embodiments disclosed above are grouped into elements and sub-elements for convenience. For example, a locking mechanism is described as including a number of individual components. Where claims recite similar elements, such claims should not be construed as including the same sub elements unless the sub-elements are explicitly recited as members of the recited elements.

The abstract of the present disclosure is provided as a brief outline of some of the principles of the invention, according to one embodiment, as an aid to searching. The abstract is not intended as a complete or definitive description of any embodiment thereof, nor should it be relied upon to define terms used in the specification or claims. The abstract does not limit the scope of the claims.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A folding knife, comprising:

a handle including first and second handle elements;

a blade coupled to the handle and configured to rotate around a pivot axis between an open position, in which a sharpened edge of the blade is exposed, and a closed position, in which the sharpened edge of the blade is positioned within a space between the first and second handle elements; and a first annular blade seal formed of a resilient material and positioned between the blade and the first handle element, a first side of the first annular blade seal making continuous contact around its entire circumference with an inner surface of the first handle element, and a second side of the first annular blade seal making continuous contact with the blade around its entire circumference.

2. The knife of claim 1, further comprising a first annular blade seal groove in the blade, coaxial with the pivot axis, the first blade seal being positioned within the first blade seal groove and contacting an inner face of the first handle element.

3. A folding knife, comprising:

a handle including first and second handle elements;

a blade coupled to the handle and configured to rotate around a pivot axis between an open position, in which a sharpened edge of the blade is exposed, and a closed position, in which the sharpened edge of the blade is positioned within a space between the first and second handle elements; and a first blade seal positioned between the blade and the first handle element, the first blade seal formed of a resilient material and including a sweep rim extending therefrom and bearing resiliently against the inner face of the first handle element.

4. The knife of claim 2, further comprising:

a second annular blade seal groove formed in the blade on a side opposite the first annular blade seal groove; and a second blade seal positioned within the second blade seal groove and contacting an inner face of the second handle element.

5. A folding knife, comprising:

a handle including first and second handle elements;

a blade coupled to the handle and configured to rotate around a pivot axis between an open position, in which a sharpened edge of the blade is exposed, and a closed position, in which the sharpened edge of the blade is positioned within a space between the first and second handle elements;

a first blade seal formed of a resilient material and positioned between the blade and the first handle element;

a second blade seal formed of a resilient material and positioned between the blade and the second handle element; and first and second control pins positioned in respective first and second control apertures in the blade.

6. The knife of claim 5, comprising an arcuate pin race formed in an inner face of the first handle element, coaxial with the pivot axis, the first and second control pins extending, respectively, from the first and second control apertures into the pin race.

7. The knife of claim 6 wherein the first blade seal has an annular shape with a diameter greater than a diameter of the first pin race, is positioned coaxially with the pivot axis, and contacts the blade and the inner face of the first handle element.

8. The knife of claim 6, comprising an additional pin race formed in an inner face of the second handle element, coaxial with the pivot axis, the second control aperture traversing the blade, and the second pin traversing the second control aperture and extending into the additional pin race.

9. The knife of claim 5, comprising a lock plate movably coupled to the first handle element and configured to engage the first and second control pins when the blade is in the open and closed positions, respectively.

10. The knife of claim 9, comprising:

an arcuate pin race formed in an inner face of the first handle element coaxially with the pivot axis, into which the first and second control pins extend from respective apertures formed in the blade;

a lock aperture formed in an outer face of the first handle element to a depth such as to intersect a portion of the pin race channel, the lock plate positioned within the lock aperture so as to engage the first and second control pins while the blade is in the open and closed positions, respectively.

11. The knife of claim 9 wherein the lock plate is configured to lockingly engage first control pin while the blade is in the open position and the lock plate is in an engaged position, and wherein the lock plate is user accessible for movement away from the engaged position to release the first pin.

12. The knife of claim 9 wherein the locking plate is configured to cooperate with the second control pin to act as a detent to hold the blade in the closed position, the detent being releasable when a threshold force is applied to the blade toward open position.

13. The knife of claim 9 wherein the locking plate includes a lock release knob accessible to a user at an outer side of the first handle element, the knife further comprising a seal element positioned in a space between the lock release knob and the first handle element.

14. The knife of claim 13 wherein the first handle element includes a handle overlay positioned on the outer side thereof, the lock release knob traversing an aperture formed in the handle overlay, and wherein the seal element comprises a bellows diaphragm positioned in the aperture formed in the handle overlay.

15. A folding knife, comprising:

a handle including first and second handle elements;

a blade coupled to the handle and configured to rotate around a pivot axis between an open position, in which a sharpened edge of the blade is exposed, and a closed position, in which the sharpened edge of the blade is positioned within a space between the first and second handle elements;

a first blade seal formed of a resilient material and positioned between the blade and the first handle element;

a pivot element extending substantially along the pivot axis and traversing pivot apertures formed in each of the first and second handle elements and the blade, the pivot element including a first enlarged head positioned on an outer side of the first handle element; and a first pivot seal positioned between the first enlarged head of the pivot element and the first handle element.

16. The knife of claim 15, comprising:

a second pivot seal;

wherein the pivot element includes a second enlarged head positioned on an outer side of the second handle element, the second pivot seal positioned between the second enlarged head of the pivot element and the second handle element.

17. The knife of claim 16 wherein the pivot element includes a first pivot screw that comprises the first enlarged head, a second pivot screw that comprises the second enlarged head, and a pivot tube traversing the pivot aperture of the blade and extending along the pivot axis, the first pivot screw engaging a first end of the pivot tube and the second pivot screw engaging a second end of the pivot tube.

18. The knife of claim 17 wherein the pivot tube has a central portion having a first diameter greater than a diameter of the pivot apertures of the first and second handle elements, and first and second end portions having a second diameter smaller than the diameter of the pivot apertures of the first and second handle elements.

19. A folding knife, comprising:

a handle having a blade channel;

a pivot fastener coupled to the handle and extending across the blade channel;

a blade positioned in the blade channel of the handle and coupled to the pivot fastener, and configured to rotate about the pivot fastener between an open position and a closed position; and a first seal positioned between the blade and a surface of a first sidewall of the blade channel and configured to substantially prevent contaminants from entering a space surrounding the pivot fastener between the blade and the first sidewall of the blade channel.

20. The knife of claim 19, comprising a second seal positioned between the blade and a surface of a second sidewall of the blade channel and configured to substantially prevent contaminants from entering a space surrounding the pivot fastener between the blade and the second sidewall of the blade channel.

21. The knife of claim 19, comprising:

a locking mechanism coupled between the handle and the blade and configured to resist rotation of the blade away from at least one of the open and closed positions while the blade is in the open and closed positions, respectively;

a release knob positioned in the handle and configured such that the locking mechanism can be released by movement of the release knob; and a second seal configured to substantially prevent contaminants from entering a space between the release knob and the handle.

22. A folding knife, comprising:

a handle having a blade channel formed therein;

a blade coupled to the handle so as to be rotatable between an open position, in which the blade extends away from the handle, and a closed position in which the blade is received in the blade channel;

first and second control pins coupled to the blade so as to extend from a first side thereof; and a lock plate having a notch formed in a first end, the lock plate being movably coupled to the handle such that, while the blade is in the open position and the lock plate is in an engaged position, the notch engages the first control pin and resists movement of the blade away from the open position, and while the blade is in the closed position and the lock plate is in the engaged position, the notch engages the second control pin and resists movement of the blade away from the closed position.

23. The knife of claim 22 wherein the notch includes first and second sides, the first side being configured to lock the blade in the open position until the lock plate is moved away from the engaged position, and the second side being configured to resist movement of the blade away from the closed position until a bias exceeding a threshold value is applied to the blade toward the open position.

24. The knife of claim 23 wherein the threshold value is selected such that a user-applied bias sufficient to move the blade away from the closed position is substantially sufficient to move the blade to the open position.

25. The knife of claim 22, further comprising first and second annular blade seals positioned coaxially with an axis of rotation of the blade and on opposite sides of the blade.

26. The knife of claim 22 wherein, while the lock plate is moved away from the engaged position, the blade is freely rotatable between the open and closed positions.

27. The knife of claim 22, comprising an arcuate groove formed in an inner face of a first side of the handle coaxial with an axis of rotation of the blade, and wherein outer ends of the first and second control pins extend into the arcuate groove so that, as the blade is rotated between the open and closed positions, the outer ends of the first and second control pins travel within the arcuate groove around the axis of rotation of the blade.

28. A folding knife, comprising:

a handle having a blade channel formed therein;

a blade coupled to the handle so as to be rotatable between an open position, in which the blade extends away from the handle, and a closed position in which the blade is received in the blade channel;

an arcuate groove formed in an inner face of a first side of the handle, coaxial with an axis of rotation of the blade;

first and second control pins coupled to the blade so as to extend from a first side thereof, outer ends of the first and second control pins extending into the arcuate groove so that, as the blade is rotated between the open and closed positions, the outer ends of the first and second control pins travel within the arcuate groove around the axis of rotation of the blade;

a cavity formed in an outer face of the first side of the handle, positioned and sized to intersect a portion of the arcuate groove;

a lock plate having a notch formed in a first end, the lock plate being positioned within the cavity, and movably coupled to the handle, so that while the blade is in the open position and the lock plate is in an engaged position, the notch of the lock plate engages the first control pin as it extends into the intersected portion of the arcuate groove, and resists movement of the blade away from the open position, and while the blade is in the closed position and the lock plate is in the engaged position, the notch engages the second control pin as it extends into the intersected portion of the arcuate groove, and resists movement of the blade away from the closed position.

29. The knife of claim 28, comprising:

an annular blade seal having a radius that is greater than a radius of the arcuate groove, positioned coaxially with the axis of rotation of the blade between the blade and the inner face of the first side of the handle;

a release knob coupled to the lock plate and extending outwardly therefrom; and a seal coupled between the release knob and the first side of the handle, configured to substantially prevent contaminants from entering the cavity.

30. A folding knife, comprising:

a handle including first and second handle elements;

a blade coupled to the handle and configured to rotate around a pivot axis between an open position, in which a sharpened edge of the blade is exposed, and a closed position, in which the sharpened edge of the blade is positioned within a space between the first and second handle elements;

a first blade seal formed of a resilient material and positioned between the blade and the first handle element, and coaxial with the pivot axis; and a locking mechanism operatively coupled between the handle and the blade, and configured to engage the blade within a perimeter defined by the first blade seal, and, while engaging the blade, to resist rotation of the blade.

31. The knife of claim 25, wherein the control pins are positioned within a circumference of the first and second annular blade seals.

32. A folding knife, comprising:

a handle including first and second handle elements;

a blade coupled to the handle and configured to rotate around a pivot axis between an open position, in which a sharpened edge of the blade is exposed, and a closed position, in which the sharpened edge of the blade is positioned within a space between the first and second handle elements; and a first blade seal formed of a resilient material and positioned between the blade and the first handle element, and including a sweep rim extending therefrom and bearing resiliently against the inner face of the first handle element.

33. A folding knife, comprising:

a handle having a blade channel;

a pivot fastener coupled to the handle and extending across the blade channel;

a blade positioned in the blade channel of the handle and coupled to the pivot fastener, and configured to rotate about the pivot fastener between an open position and a closed position;

a locking mechanism coupled between the handle and the blade and configured to resist rotation of the blade away from the open and closed positions while the blade is in the open and closed positions, respectively;

a release knob positioned in the handle and configured such that the locking mechanism can be released by movement of the release knob; and a seal positioned and configured to substantially prevent contaminants from passing the release knob into a space surrounding the locking mechanism.

34. The folding knife of claim 32, comprising a second seal positioned between the blade and a surface of a sidewall of the blade channel and configured to substantially prevent contaminants from entering a space surrounding the pivot fastener between the blade and the sidewall of the blade channel.

35. The folding knife of claim 1, comprising a locking mechanism coupled between the handle and the blade and engaging the blade inside the circumference of the first blade seal, the locking mechanism being configured to resist rotation of the blade away from at least one of the open and closed positions while the blade is in the open and closed positions, respectively.

36. The knife of claim 19 wherein the first seal is annular in shape and makes continuous contact around its entire perimeter with the first sidewall of the blade channel.

* * * * *